US009587905B1

(12) United States Patent
Biedenbach et al.

(10) Patent No.: US 9,587,905 B1
(45) Date of Patent: Mar. 7, 2017

(54) GUN SLIDE GRIP

(71) Applicant: Arachnigrip LLC, Parker, CO (US)

(72) Inventors: Robert Colton Biedenbach, Parker, CO (US); Donald Hoekendorf, Parker, CO (US)

(73) Assignee: Arachnigrip LLC, Parker, CO (US)

( * ) Notice: Subject to any disclaimer, the term of this patent is extended or adjusted under 35 U.S.C. 154(b) by 0 days.

(21) Appl. No.: 14/993,976

(22) Filed: Jan. 12, 2016

Related U.S. Application Data

(60) Provisional application No. 62/103,966, filed on Jan. 15, 2015.

(51) Int. Cl.
*F41C 27/00* (2006.01)
*F41C 23/10* (2006.01)

(52) U.S. Cl.
CPC ..... *F41C 23/10* (2013.01)

(58) Field of Classification Search
USPC ..... 42/106, 90
See application file for complete search history.

(56) References Cited

U.S. PATENT DOCUMENTS

| | | | |
|---|---|---|---|
| 2,718,033 | A | 9/1955 | Burke |
| 4,145,065 | A | 3/1979 | Kupka |
| 4,310,509 | A | 1/1982 | Berglund |
| 4,460,187 | A | 7/1984 | Shimizu |
| 4,504,549 | A | 3/1985 | Pines |
| 4,568,566 | A | 2/1986 | Tolentino |
| 4,613,537 | A | 9/1986 | Krupper |
| 5,622,759 | A | 4/1997 | Fuster |
| 6,416,604 | B1 | 7/2002 | Nootbaar |
| 6,755,350 | B2 | 6/2004 | Rochford et al. |
| 6,783,692 | B2 | 8/2004 | Bhagwagar |
| 6,855,651 | B2 | 2/2005 | Yu |
| 7,014,910 | B2 | 3/2006 | Rochford et al. |
| D560,750 | S | 1/2008 | Potter |
| 7,329,232 | B2 | 2/2008 | Lipshaw et al. |
| 7,625,625 | B2 | 12/2009 | Rios et al. |
| 7,897,233 | B2 | 3/2011 | Esposito et al. |
| D696,784 | S | 12/2013 | Ibrahim et al. |
| D702,308 | S | 4/2014 | Glock |

(Continued)

OTHER PUBLICATIONS www.americanrifleman.org, Handi-Racker Slide Assist Device, Jul. 15, 2014.

(Continued)

*Primary Examiner* — J. Woodrow Eldred
(74) *Attorney, Agent, or Firm* — Marsh Fischmann & Breyfogle LLP

(57) ABSTRACT

A gun slide grip is provided for installed use on a gun slide. The gun slide grip includes a flexible sheet member having a bottom side with an adhesive surface for attachment to a gun slide and a top side with a grip surface for engagement by user. The sheet member includes a body portion for positioning on a top side of a gun slide, and first and second segmented portions integrally adjoined to the body portion. The first segmented portion includes a first plurality of fingers for interposed positioning with a first plurality of serrations provided on a first side of a gun slide. The second segmented portion includes a second plurality of fingers interposed positioning with a second plurality of serrations provided on a second side of a gun slide. The body portion may include one or more alignment features for use in installing the gun slide grip on a gun slide.

20 Claims, 10 Drawing Sheets

(56) References Cited

U.S. PATENT DOCUMENTS

| | | | |
|---|---|---|---|
| D731,069 | S | 6/2015 | Bialek |
| 2003/0027475 | A1 | 2/2003 | Yu |
| 2003/0211900 | A1 | 11/2003 | Novak |
| 2003/0232900 | A1 | 12/2003 | Irifune |
| 2005/0181164 | A1 | 8/2005 | Piumarta et al. |
| 2007/0178282 | A1 | 8/2007 | Miekka |
| 2009/0162596 | A1 | 6/2009 | Rios et al. |
| 2009/0162651 | A1 | 6/2009 | Rios et al. |
| 2010/0183814 | A1 | 7/2010 | Rios et al. |
| 2011/0072705 | A1 | 3/2011 | Simpkins |
| 2011/0289812 | A1 | 12/2011 | Losinger |
| 2013/0180152 | A1 | 7/2013 | Speroni |
| 2013/0248089 | A1 | 9/2013 | Su et al. |
| 2014/0047753 | A1 | 2/2014 | Grossman et al. |

OTHER PUBLICATIONS www.AR15.com, Glock non skid tape, Jul. 15, 2014.
www.ebay.com, MAK0 FAB Tactic-Skin Pistol Gun Slide Cover Anti Slip Grip Glock, Jul. 15, 2014.
NRA, Police Pistol Combat Program Bulletin, Anti-Slip Tape on Slide Sides, Aug. 6, 2012.
www.xdtalk.com, Anybody use non-skid tape on their grips?, Jul. 15, 2014.

GUN SLIDE GRIP

CROSS REFERENCE TO RELATED APPLICATION

This application claims priority from U.S. Provisional Patent Application No. 62/103,966 filed on Jan. 15, 2015 entitled "GUN SLIDE GRIP," the entirety of which is incorporated by reference herein.

FIELD

The present disclosure relates generally to implements used in association with a gun slide and, more particularly, to apparatus and methods for facilitating engagement of a gun slide by a user.

BACKGROUND

In the use of various firearms, including in particular pistols, the action of expelling spent bullet casings and loading a fresh round into a firing chamber is known as cycling. Such cycling typically entails a rearward motion and forward motion of a gun slide that is slidably mounted to a pistol. As may be appreciated, such motion may entail gripping the hand grip portion of a pistol with one hand while engaging another hand with the gun slide to apply a force that promotes the desired gun slide movement. For some users, the required engagement with a gun slide to achieve the desired cycling movement can be problematic, i.e. primarily due to a lack of gripping strength.

SUMMARY

In view of the foregoing, a primary objective of the present disclosure is to provide a gripping surface on a gun slide, thereby facilitating improved cycling of a firearm such as a hand-held pistol.

In one aspect, a gun slide grip is provided for installed use on a gun slide. The gun slide grip may include a flexible sheet member having a bottom side with an adhesive surface for attachment to a gun slide and a top side with a grip surface for engagement by a user. The flexible sheet member may include a body portion for positioning on a top side of a gun slide, and a first segmented portion integrally adjoined to the body portion, wherein the first segmented portion may include a first plurality of fingers for interposed positioning with a first plurality of serrations provided on a gun slide (e.g. in the serrations or grooves). Further, the sheet member may also comprise a second segmented portion integrally adjoined to the body portion, wherein the second segmented portion may include a second plurality of fingers for interposed positioning with a second plurality of serrations provided on the gun slide (e.g. in the serrations or grooves). The integrally adjoined portion and first and second segmented portions of the sheet member advantageously allow for handling and installation of the gun slide grip as a single-piece unit.

In contemplated arrangements, the first plurality of fingers may extend away from the body portion in a first direction on a first side of a center axis of the body portion for interposed positioning in the first plurality of serrations on a first side of a gun slide, and the second plurality of fingers may extend away from the body portion in a second direction on a second side of the center axis of the body portion for interposed positioning with the second plurality of serrations on a second side of the gun slide opposite to the first side.

The first plurality of fingers may be of the same length or of varying lengths. Similarly, the second plurality of fingers may be of the same length or of varying lengths. Moreover, the first plurality of fingers and the second plurality of fingers may of the same length or of varying lengths.

As noted, a top side of the flexible sheet member may be provided with a grip surface to facilitate engagement by a user. Such grip surface may be provided to have a co-efficient of friction that is greater than a co-efficient of friction of a gun slide to which the gun slide grip is attached. By way of example, the grip surface may comprise abrasive particles in a matrix (e.g. silicon carbide and/or aluminum oxide particles in a polymer matrix), an elastomer material, or another grip-defining material.

In some implementations, the gun slide grip may include a removable release liner overlaying the adhesive surface. The removable release liner may be readily removed at the time of installation of the gun slide grip on a gun slide. Optionally, the removable release liner may comprise a first portion and a second portion that are separated to allow for selective, separate removal from the adhesive surface. For example, the first portion of the release liner may be at least partially removed to expose a first portion of the adhesive surface, wherein the exposed first portion of the adhesive surface may be positioned relative to and engaged with a first desired location on a gun slide. Further, the second portion of the release liner may be at least partially removed to expose a second portion of the adhesive surface, wherein the exposed second portion of the adhesive surface may be positioned relative to and engaged with a second desired addition on the gun slide. In conjunction with the removal of the first and/or second portions of the releasable liner, adhesive surface portions corresponding with the first plurality of fingers and/or second plurality of fingers maybe selectively positioned relative to and engaged with a first plurality of serrations on the gun slide and a second plurality of serrations on the gun slide, respectively.

In some arrangements, to facilitate positioning of a gun slide grip on the gun slide, the body portion of the sheet member may include at least one alignment feature for use in aligning a center axis of the body portion with a longitudinal axis of the gun slide on a top side of the gun slide. The alignment feature may comprise at least one of a physical configuration feature and a visual marking feature (e.g. one or more marking(s) printed on the sheet member).

Various approaches may be utilized for providing a physical configuration feature. In particular, an alignment feature comprising a physical configuration feature may be defined by one or more projection portion(s) located along an edge of the body portion, one or more recessed portion(s) located along an edge of the body portion, and/or one or more opening(s) extending through the body portion.

In one approach, an alignment feature may comprise at least one physical configuration feature defined by a first projecting tab located along a first edge of the body portion. The first projecting tab may be centered on a center axis of the body portion to facilitate alignment. Additionally or alternatively, a physical configuration feature may comprise a first pair of recesses that comprises a recess located on each side of the center axis of the body portion, wherein each of the recesses is offset by an equal distance from the center axis. In one embodiment, a pair of recesses may be provided on each side of a first projecting tab on a first edge of the body portion, wherein each of the recesses are offset an equal distance from the first projecting tab. Additionally or alternatively, a physical configuration feature may comprise an opening extending through the body portion that is centered on a center axis of the body portion (e.g. an opening with coincidental, or mirror-like, opening portions disposed on each side of such center axis).

In one arrangement, in addition to a first projecting tab on a first edge of the body portion, a second projecting tab may be provided on a second edge of the body portion, wherein each of the first projecting tab and second projecting tab are centered on the center axis of the body portion. Further, in addition to a first pair of recesses located on the first edge of the body portion, a second pair of recesses may be provided on the second edge of the body portion, wherein each of the second pair of recesses is offset from the center axis of the body portion and the second projecting tab by equal distances.

In each of the above-noted arrangements that include an alignment feature, such alignment feature may be located for positioning on a top side of a gun slide. That is, the alignment feature may be provided so that, when the gun slide grip is attached to a gun slide, the alignment feature is disposed on a top side of the gun slide, thereby facilitating aligned positioning of the alignment feature.

In some implementations when the sheet member is in a planar configuration prior to installation, each of the first plurality of fingers and each of the second plurality of fingers may be provided to extend at a 90° angle along an entirety thereof relative to a center axis of the body portion. In other arrangements, when the sheet member is in a planar configuration prior to installation, each of the first plurality of fingers and each of the second plurality of fingers may be provided to extend at a common oblique angle along an entirety thereof relative the center axis of the body portion. In yet a further approach, when the sheet member is in a planar configuration prior to installation, a first portion of each of the first plurality of fingers and each of the second plurality of fingers may extend at a first angle relative to the center axis of the body portion. Further, a second portion adjoining the first portion of each of the first plurality of fingers and each of the second plurality of fingers may extend at a second angle relative to the center axis of the body portion, wherein the first angle and second angle are different.

In another aspect, a gun slide is provided that comprises a U-shaped channel member having a top side and opposing first and second sides, wherein the first side includes a first plurality of serrations and the second side includes a second plurality of serrations. The gun slide may further comprise a continuous grip surface for engagement by a user. The continuous grip surface may include a body portion disposed on the top side of the channel member, a first segmented portion integrally adjoined to the body portion and including a first plurality of fingers disposed in the first plurality of serrations on the first side of the gun slide, and second segmented portion integrally adjoined to the body portion and having a second plurality of fingers disposed in the second plurality of serrations on the second side of the gun slide. In some implementations, the grip surface may comprise abrasive particles in a matrix, an elastomer material, or the grip-defining material.

The body portion of the gun slide grip may include at least a first projecting tab located along a first edge of the body portion, wherein the first projecting tab may be centered on a center axis of the body portion. Further, the body portion may include a first pair of recesses comprising a recess on each side of the first projecting tab along the first edge, each of the first pair of recesses may be offset by an equal distance from the center axis of the body portion.

In some implementations, the gun slide grip may further include a second projecting tab located along a second edge of the body portion, wherein the first and second projecting tabs are each centered on the center axis of the body portion. Further, a second pair of recesses may be provided on each side of the second projecting tab along the second edge of the body portion.

In some arrangements, the grip surface may be defined by a sheet member having attributes as described herein. In that regard, the sheet member may have a bottom side with an adhesive surface adhered to the top side of the channel member of the gun slide.

In a further aspect, a method for installing a grip surface on a gun slide is provided. The method includes the steps of positioning a flexible sheet member having a grip surface on a top side relative to a gun slide, and adhering a bottom side of the flexible sheet member to the gun slide. In relation to the positioning step, a body portion of the sheet member may be located on the top side of the gun slide, a first plurality of fingers of a first segmented portion, integrally adjoined to the body portion, may be located in a first plurality of serrations on a first side of the gun slide, and second plurality of fingers of a second segmented portion, integrally adjoined to the body portion, may be located in a second plurality of serrations on a second side of the gun slide.

Method embodiments may further include the step of removing a release liner from at least a portion of the adhesive surface on the bottom side of the flexible sheet member prior to at least a portion of the positioning step and prior to at least portion of the adhering step. Further, the positioning step may include the sub-step of using at least one alignment feature of the body portion to align the center axis of the body portion with a longitudinal axis of the gun slide on the top side thereof. Such alignment feature may include one or more of the visual marking and physical configuration features referenced herein.

Numerous additional features and advantages of the present invention will become apparent to those skilled in the art upon consideration of the embodiment descriptions provided hereinbelow.

DETAILED DESCRIPTION

Disclosed herein are utilities (e.g., systems, processes, apparatuses, etc.) for a gun slide grip for installed use on a gun slide. The disclosed utilities may employ a flexible sheet member having a bottom side with an adhesive surface for attachment to a gun slide (e.g., to mate the gun slide grip on to the gun slide). The flexible sheet member may also include a top side with a grip surface for engagement by a user (e.g., to facilitate gripping engagement of a gun slide by a user). The flexible sheet member of the gun slide grip may also include a body portion for positioning on a top side of the gun slide (e.g., to facilitate alignment of the gun slide grip onto the gun slide) and at least a first segmented portion integrally joined to the body portion and including a first plurality of fingers for interposed positioning with a first plurality of serrations on the gun slide (e.g. in the serrations or grooves). In this regard, the gun slide grip may be operable for conformal attachment to the gun slide to facilitate the engagement of the gun slide by the user.

Reference will now be made to the accompanying drawings, which assist in illustrating the various pertinent features of the various novel aspects of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

Figure 1:
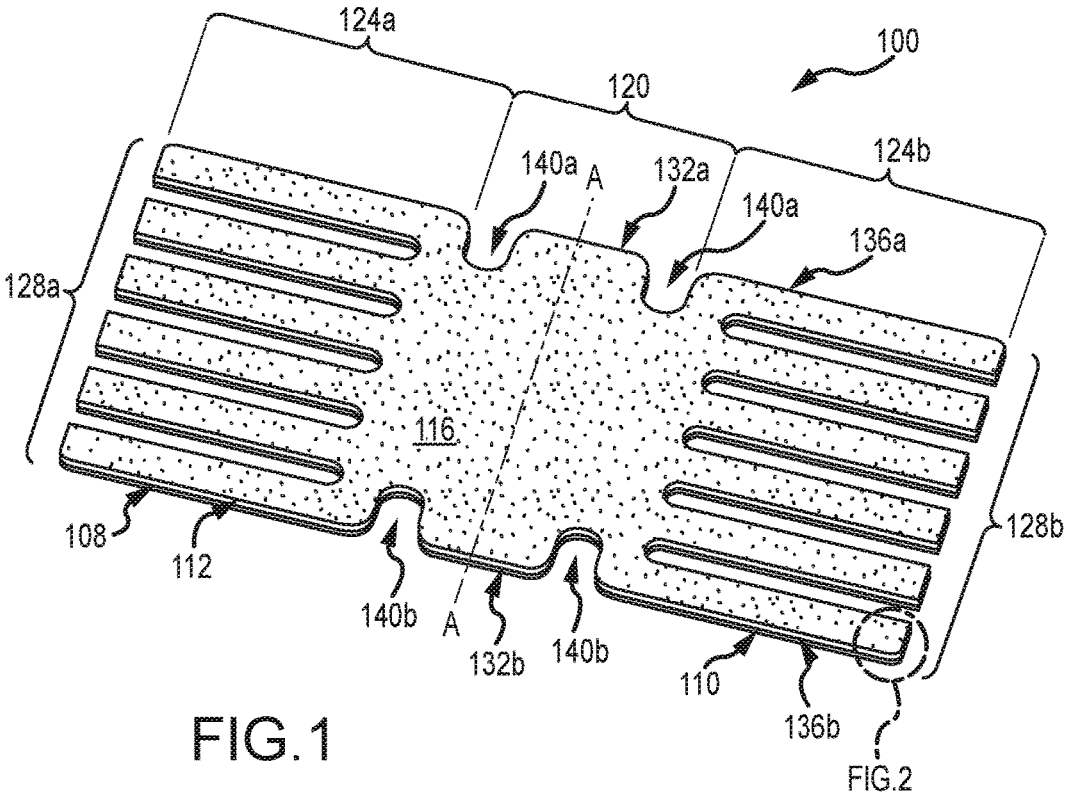
FIG. 1 is a top isometric view of an embodiment of a gun slide grip.
Figure 2:
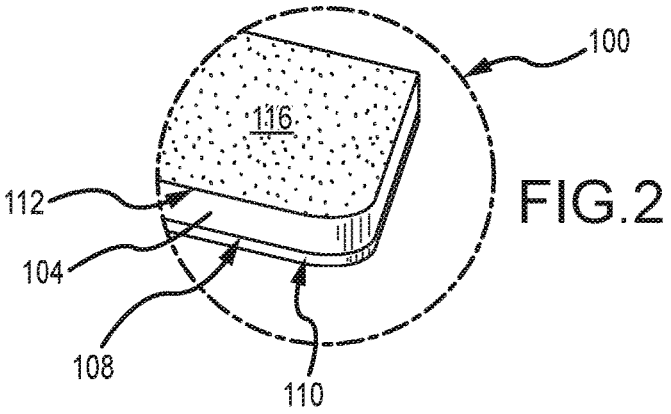
FIG. 2 is a detailed cross-sectional view of the embodiment of the gun slide grip of FIG. 1.

In this regard, FIGS. 1 and 2 illustrate an embodiment of a gun slide grip 100. Broadly, the gun slide grip 100 may include a flexible sheet member 104 having a bottom side 108 with an adhesive surface (not shown in FIG. 1) for attachment to a gun slide. The flexible sheet member 104 may also include a top side 112 with a grip surface 116 for engagement by a user. In this regard, the flexible sheet member 104 may further include a body portion 120 for positioning on a top side of a gun slide and at least a first segmented portion 124*a* integrally joined to the body portion 120. The adhesive surface may be overlaid by a removable release liner 110 to substantially cover the adhesive surface of the gun side grip 100 prior to installation on a gun slide. Notably, the first segmented portion 124*a* may include a first plurality of fingers 128*a* for interposed positioning with a first plurality of serrations of the gun slide. In some embodiments, the flexible sheet member 104 may also include a second segmented portion 124*b* integrally joined to the body portion 120. In this regard, the second segmented portion 124*b* may include a second plurality of fingers 128*b* for interposed positioning with a first plurality of serrations on the gun slide (e.g. in the serrations or grooves).

According to one embodiment, the first plurality of fingers 128*a* may extend away from the body portion 120 in a first direction on a first side of a center axis AA of the body portion 120 for interposed positioning with the first plurality of serrations on the first side of the gun slide, while the second plurality of fingers 128*b* may extend away from the body portion 120 in a second direction on a second side of the center axis AA of the body portion 120 for interposed positioning with the second plurality of serrations on a second side of the gun slide. In some embodiments, the first direction and second direction may be opposite opposing directions.

Furthermore, the body portion 120 may include at least one alignment feature for use in aligning a center axis AA of the body portion 120 with a longitudinal axis of the gun slide on the top side thereof. In this regard, the at least one alignment feature may include at least one of a physical configuration feature and a visual marking feature. According to one embodiment, the alignment feature of body portion 120 includes at least one physical configuration feature. According to this embodiment, the at least one physical configuration feature may include at least one of a projection portion located along an edge of the body portion 120, a recessed portion located along an edge of the body portion 120, and an opening extending through the body portion 120.

For example, the body portion 120 may include at least one physical configuration feature defined by a first projecting tab 132*a* located a long a first edge 136*a* of said body portion 120 such that the first projecting tab 132*a* is centered on a center axis AA of the body portion 120. Additionally or alternatively, the body portion 120 may include at least one physical configuration feature defined by a first pair of recesses 140*a* that includes a recess disposed on each side of the first projecting tab 132*a* along the first edge 136*a*. Each of the first pair of recesses 140*a* may be offset by an equal distance from the center axis AA of the body portion 120. In the same or other embodiments, the body portion 120 may include at least one physical configuration feature defined by a second projecting tab 132*b* located a long a second edge 136*b* of said body portion 120 such that the second projecting tab 132*b* is centered on the center axis AA of the body portion 120. In this regard, both a first projecting tab 132*a* and a second projecting tab 132*b* may be provided, wherein each of the tabs 132*a* and 132*b* may be centered on the center axis AA of the body portion 120 to facilitate positioning of the gun slide grip 100 on the gun slide.

Additionally or alternatively, the body portion 120 may include at least one physical configuration feature defined by a second pair of recesses 140*b* that includes a recess disposed on each side of the second projecting tab 132*b* along the second edge 136*b*. Additionally or alternatively, the first edge 136*a* and second edge 136*b* may be disposed opposite each other on the body member 120 such that, for example, first projecting tab 132*a* and second projecting tab 132*b* are disposed on opposite edges of body member 120. Accordingly, the first edge 136*a* and second edge 136*b* may be disposed opposite each other on the body member 120 such that the first pair of recesses 140*a* and second pair of recesses 140*b* are disposed on opposite edges of body member 120. In this regard, as discussed in greater detail below, the disposition of the at least one physical configuration feature may facilitate the aligning of the center axis AA of the body portion 120 with the longitudinal axis of gun slide on the top side thereof.

With specific reference to FIG. 2, the sheet member 104 may include a bottom side 108 and a top side 112. As such, the sheet member 104 may include a plurality of layers to form a composite member for conformal attachment to a gun slide. Each of the plurality of layers may include various characteristics and/or configurations. For example, the top side 112 may include a grip surface 116 for engagement by the user (e.g., for grippable engagement, slidable engagement, etc.). The grip surface 116 may be of any appropriate configuration or materials to facilitate the engagement of the gun slide by the user. According to some embodiments, the grip surface 116 may include abrasive particles in a matrix (e.g., silicon carbide and/or aluminum oxide particles in a matrix), an elastomer material, and/or another grip-defining material. In this regard, the grip surface 116 may be of a texture and/or composition such that a corresponding coefficient of friction of the grip surface 116 facilitates the engagement of the gun slide by the user (e.g., such that the user may manipulate the gun slide via tactile engagement with the gun slide grip 100). In some instances, engagement of the grip surface 116 facilitates the engagement of the gun slide by the user, as discussed in greater detail below, via bottom side 108 (e.g., by selective conformal attachment of the bottom side 108 to a gun slide, etc.).

Figure 3:
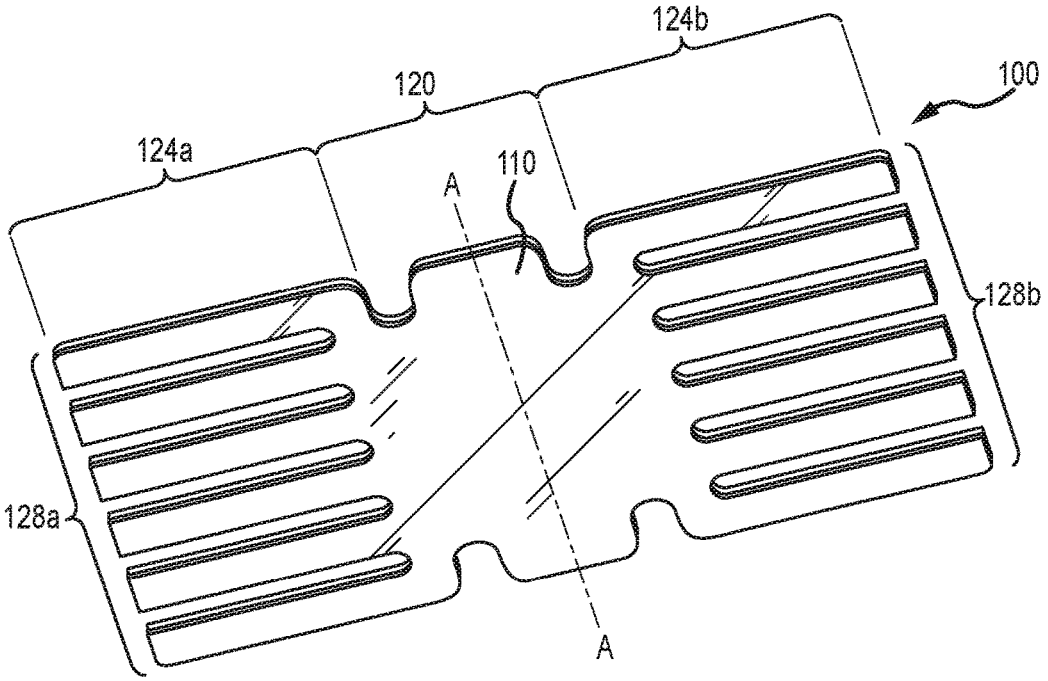
FIG. 3 is a bottom isometric view of a portion of the embodiment of the gun slide grip of FIG. 1.

Turning now to FIG. 3, gun slide grip 100 is depicted in a state where the adhesive surface (not numbered in FIG. 3) of bottom side 110 is overlaid by the removable release liner 110. The removable release liner 110 may facilitate the selective conformal attachment of the bottom side 108 to a gun slide by covering the adhesive surface of bottom side 108 prior to installation on the gun slide. That is, by covering the adhesive surface of bottom side 108 of the sheet member 104, the release liner 110 may preserve the adhesive properties of the adhesive surface for optimal conformal attachment to the gun slide.

Figure 4:
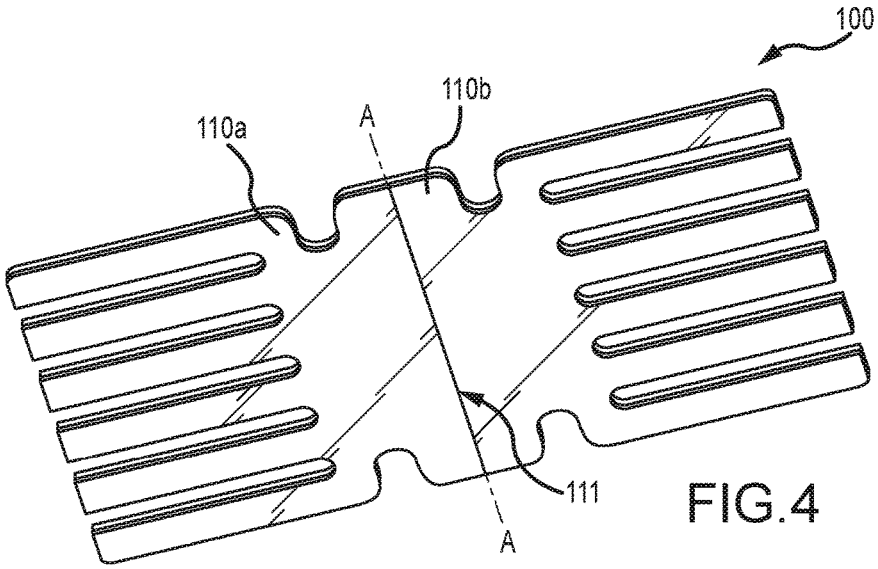
FIG. 4 is a bottom isometric view according to another embodiment of the gun slide grip of FIG. 1.

According to one embodiment, such as that depicted in FIG. 4, the removable release liner 110 may include a removable first portion 110*a* and a removable second portion 110*b*. The removable first portion 110*a* and removable second portion 110*b* may be separated along a slit 111 for selective, separate removal from the adhesive surface of bottom side 108, as depicted in FIG. 5.

Figure 5:
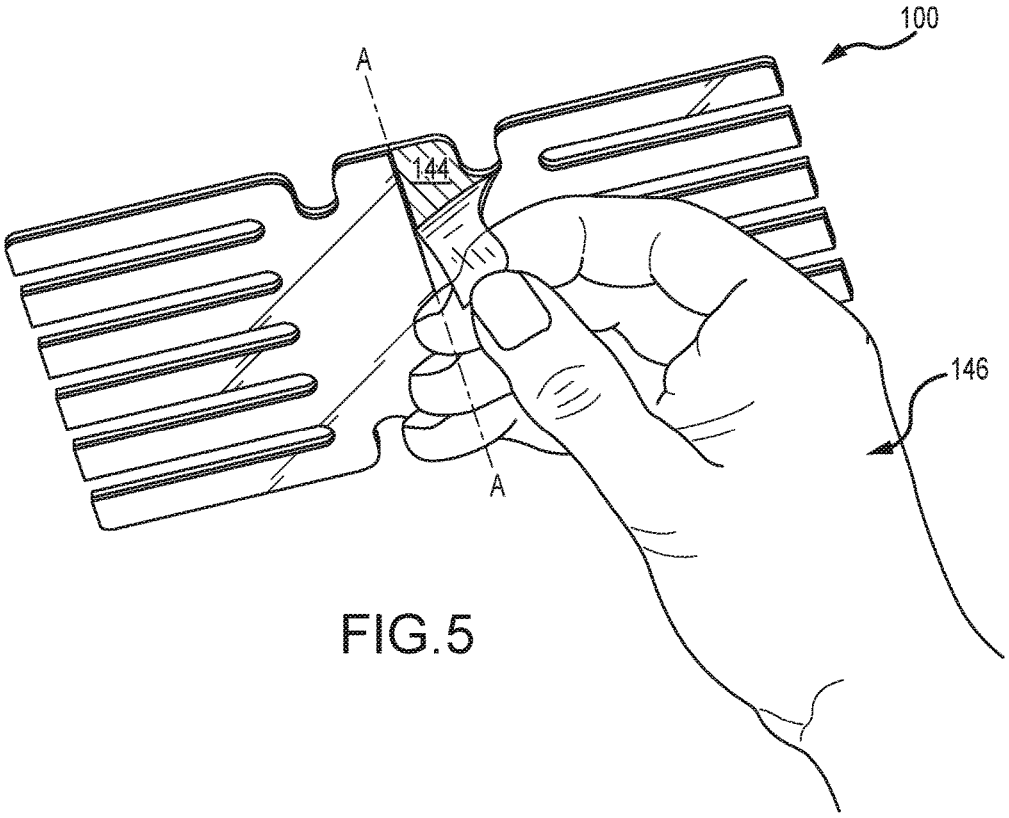
FIG. 5 is a bottom isometric view of an embodiment of the gun slide grip of FIG. 1 depicted in a state where a removable release liner is at least partially removed from a bottom side of the gun slide grip.

In this regard, FIG. 5 presents a bottom perspective view in which removable second portion 110*b* is depicted in a state in which it is at least partially removed from bottom side 108 to expose a portion of adhesive surface 144. As may be appreciated, a user may partially remove the removable second portion 110*b* via a hand 146 of the user. The exposed adhesive surface 144, as discussed in greater detail below, may facilitate conformal attachment to the gun slide.

Figure 6:
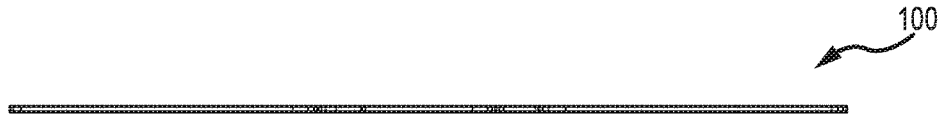
FIG. 6 is a front view of the gun slide grip of FIG. 1.
Figure 7:
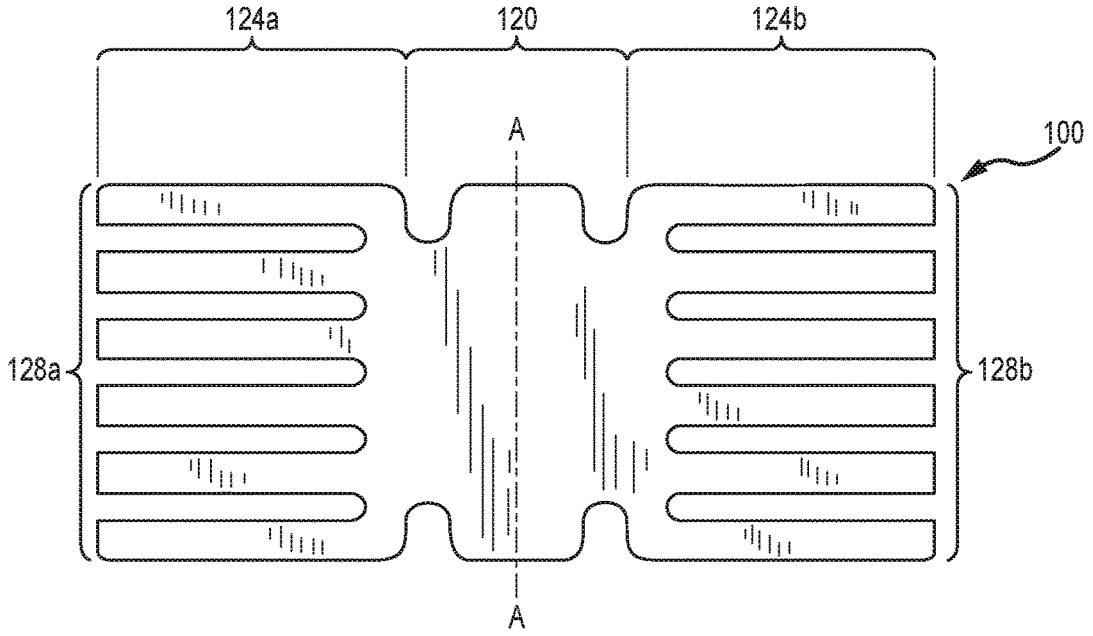
FIG. 7 is a top view of the embodiment of the gun slide grip of FIG. 1.

Turning now to FIGS. 6-7, a gun slide grip 100 is presented according to one embodiment. In this regard, as depicted in FIG. 6, the gun slide grip 100 may be in a substantially planar configuration prior to installation on a gun slide. As noted above, the gun slide grip 100 may include a first plurality of fingers 128*a*, corresponding to a first segmented portion 124*a*, for interposed positioning with a first plurality of serrations of a gun slide. Similarly, the gun slide grip 100 may include a second plurality of fingers 128*b*, corresponding to a second segmented portion 124*b*, for interposed positioning with a second plurality of serrations of the gun slide. According to the embodiment depicted in FIG. 6, each of the first plurality of fingers 128*a* and each of the second plurality of fingers 128*b* may extend at a 90° angle along in entirety thereof relative to the center axis AA of the body portion 120. In this regard, each of the first plurality of fingers 128*a* and the second plurality of fingers 128*b* may be disposed relative to the body member 120 to facilitate conformal attachment to the gun slide for engagement of the gun slide by the user.

Figure 8:
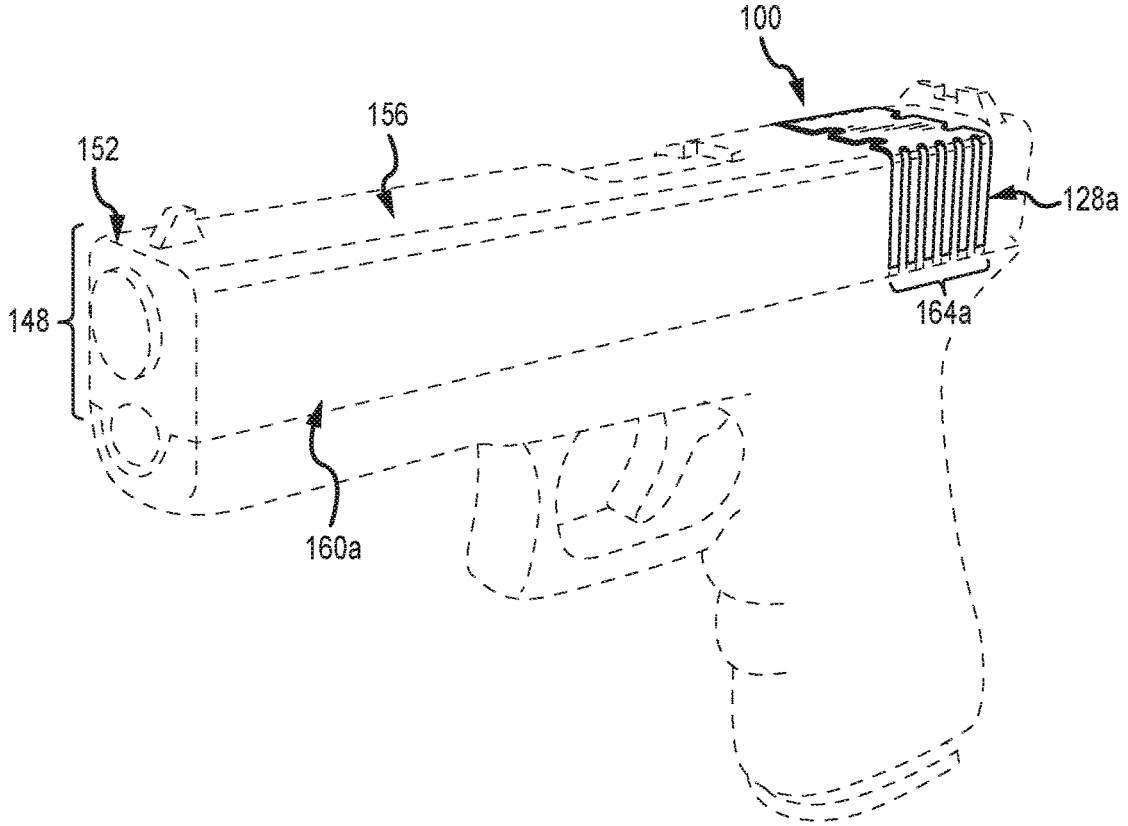
FIG. 8 depicts a right side isometric view of the embodiment of the gun slide grip of FIG. 1 in a state in which the gun slide grip is installed on a gun slide.
Figure 9:
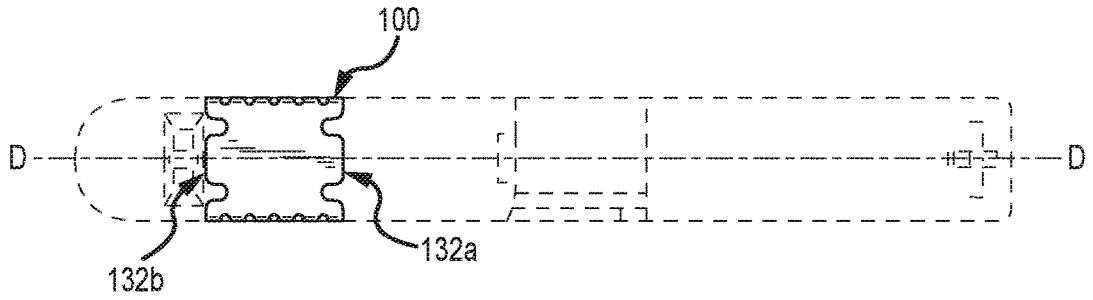
FIG. 9 depicts a top view of the embodiment of the gun slide grip of FIG. 1 in a state in which the gun slide grip is installed on a gun slide.
Figure 10:
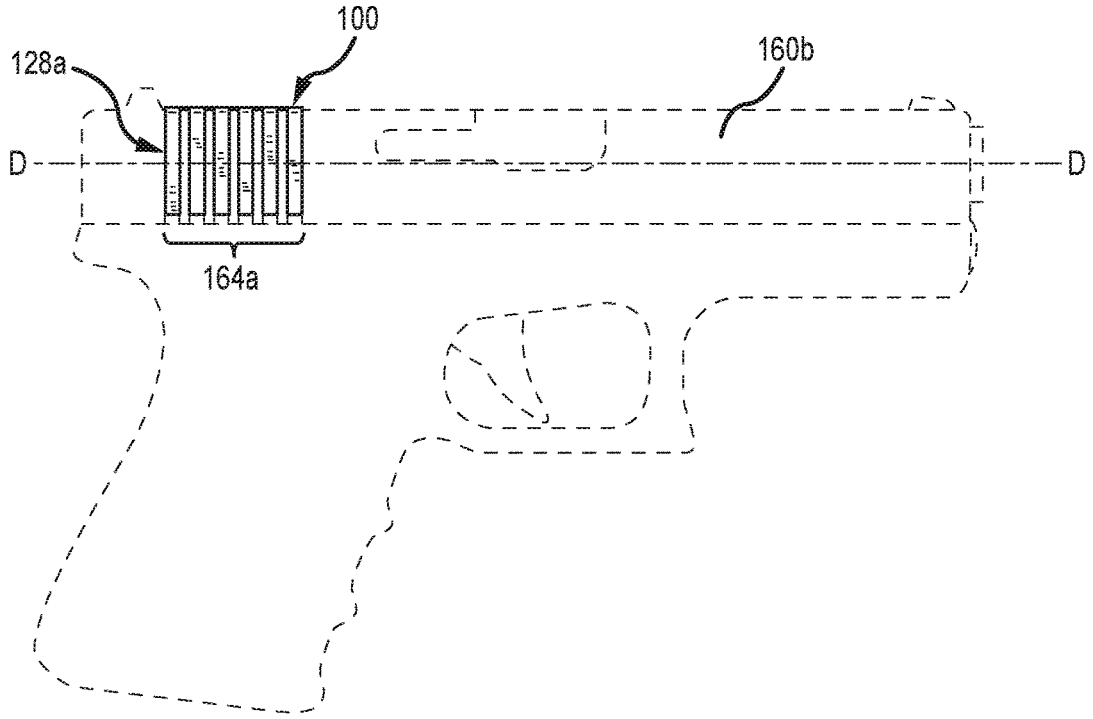
FIG. 10 depicts a left side view of the embodiment of the gun slide grip of FIG. 1 in a state in which the gun slide grip is installed on a gun slide.

Turning now to FIGS. 8-10, a gun slide grip 100 is depicted in a state in which the gun slide grip 100 is installed on gun slide 148. Broadly, gun slide 148 may comprise a U-shaped channel member 152 having a top side 156, an opposing first side 160*a*, and a second side 160*b* opposite the first side 160*a*. The first side 160*a* may include a first plurality of serrations 164*a* (e.g., notches, grooves, or other indentations or voids disposed with in the first side 160*a*). Similarly, the second side 160*b* may also include a second plurality of serrations 164*b* symmetrically disposed on the second side 160*b* and of corresponding configuration to the first plurality of serrations 164*a*. Gun slide 148 may further include a continuous grip surface (e.g., grip surface 116) for engagement by a user. Notably, continuous grip surface may be defined by a flexible sheet member having a bottom side for adherence to the channel member 152.

Accordingly, gun slide grip 100 may be disposed on a gun slide (e.g., gun slide 148) in a manner as depicted in FIG. 8. In particular, according to one embodiment, the body portion 120 may be mounted to the top side 156 for selective adherence to channel member 152. In some instances, the body portion 120 may include at least one alignment feature (e.g., a first projecting tab 132*a* disposed on first edge 136*a*, as discussed above) for centered positioning of the body portion 120 on top side 156 of channel member 152 with respect to a longitudinal axis of the gun slide 148. Moreover, the first plurality of fingers 124*a* may be mounted to the first plurality of serrations 164*a* such that the first plurality of fingers 124*a* are disposed for selective interposed adherence to the first plurality of serrations 164*a*. Similarly, the second plurality of fingers 124*b* may be mounted to the second plurality of serrations 164*b* such that the second plurality of fingers 124*b* are disposed for selective interposed adherence to the second plurality of serrations 164*b*.

Figure 11:
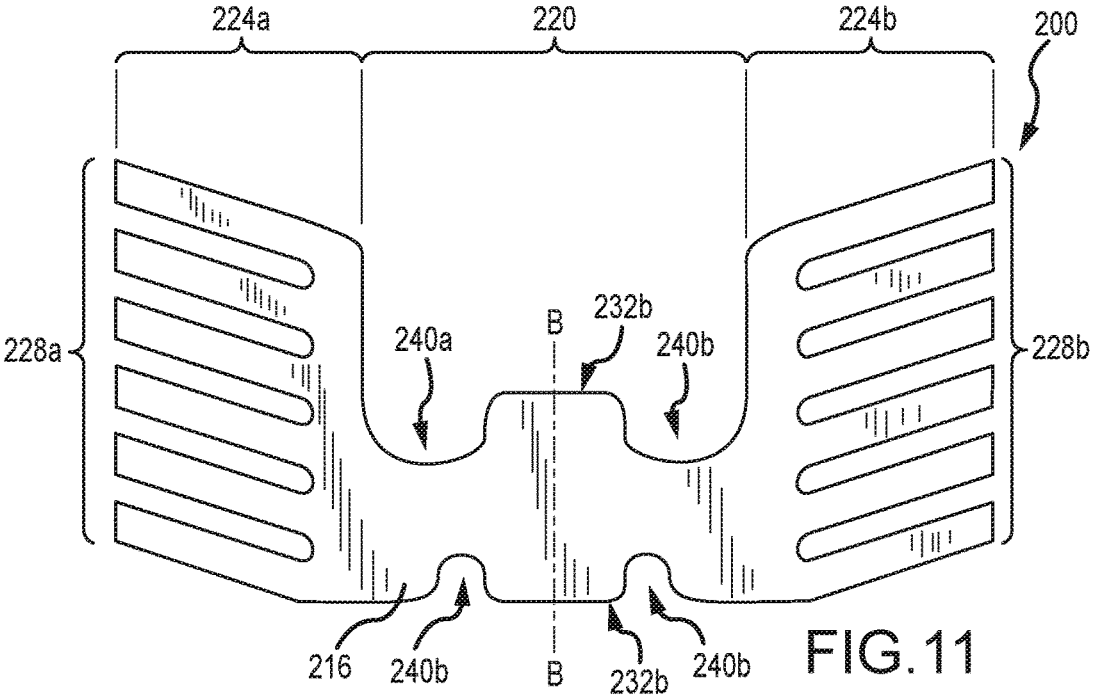
FIG. 11 is a top view of a gun slide grip, according to another embodiment.
Figure 12:
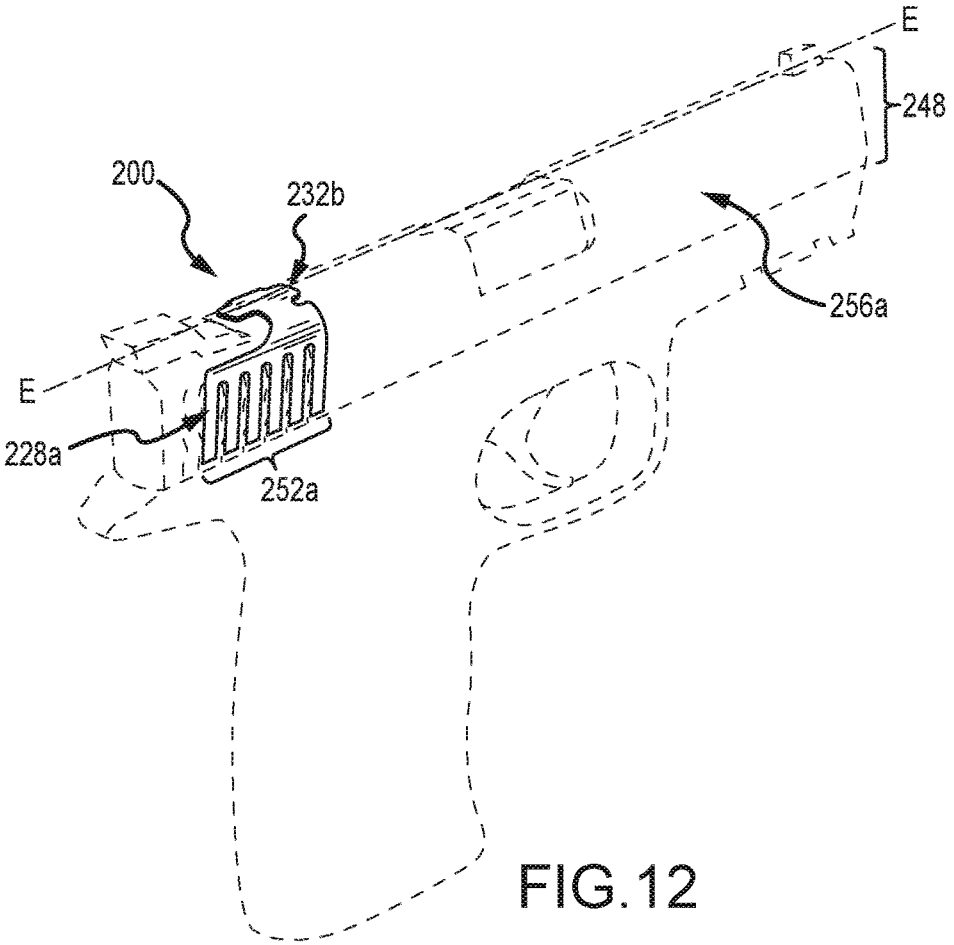
FIG. 12 depicts a side isometric view of the embodiment of the gun slide grip of FIG. 8 in a state in which the gun slide grip is installed on a gun slide.

Turning now to FIGS. 11-12, a gun slide a grip 200 is depicted, according to another embodiment. Broadly, the gun slide grip 200 may include a flexible sheet member 204 having a bottom side 208 with an adhesive surface (not shown in FIG. 11) for attachment to a gun slide. The flexible sheet member 204 may also include a top side 212 with a grip surface 216 for engagement by a user. In this regard, the flexible sheet member 204 may further include a body portion 220 for positioning on a top side of a gun slide and at least a first segmented portion 224*a* integrally joined to the body portion 220. The adhesive surface may be overlaid by removable release liner 210 to substantially cover the adhesive surface of the gun slide grip 200 prior to installation on a gun slide. Notably, the first segmented portion 224*a* may include a first plurality of fingers 228*a* for interposed positioning with a first plurality of serrations of the gun slide. In some embodiments, the flexible sheet member 204 may also include a second segmented portion 224*b* integrally joined to the body portion 220. In this regard, the second segmented portion 224*b* may include a second plurality of fingers 228*b* for interposed positioning with a first plurality of serrations on the gun slide.

According to one embodiment, the first plurality of fingers 228*a* may extend away from the body portion 220 in a first direction on a first side of a center axis BB of the body portion 220 for interposed positioning with the first plurality of serrations on the first side of the gun slide, while the second plurality of fingers 228*b* may extend away from the body portion 220 in a second direction on a second side of the center axis BB of the body portion 220 for interposed positioning with the second plurality of serrations on a second side of the gun slide.

Furthermore, the body portion 220 may include at least one alignment feature for use in aligning a center axis BB of the body portion 220 with a longitudinal axis of the gun slide on the top side thereof. In this regard, the at least one alignment feature may include at least one of a physical configuration feature and a visual marking feature. According to one embodiment, the alignment feature of body portion 220 includes at least one physical configuration feature. According to this embodiment, the at least one physical configuration feature may include at least one of a projection portion located along an edge of the body portion 220, a recessed portion located along an edge of the body portion 220, and an opening extending through the body portion 220.

For example, the body portion 220 may include at least one physical configuration feature defined by a first projecting tab 232*a* located a long a first edge 236*a* of said body portion 220 such that the first projecting tab 232*a* is centered on a center axis BB of the body portion 220. Additionally or alternatively, the body portion 220 may include at least one physical configuration feature defined by a first pair of recesses 240*a* that includes a recess disposed on each side of the first projecting tab 232*a* along the first edge 236*a*. Each of the first pair of recesses 240*a* may be offset by an equal distance from the center axis BB of the body portion 220. In the same or other embodiments, the body portion 220 may include at least one physical configuration feature defined by a second projecting tab 232*b* located a long a second edge 236*b* of said body portion 220 such that the second projecting tab 232*b* is centered on the center axis BB of the body portion 220. In this regard, both a first projecting tab 232*a* and a second projecting tab 232*b* may be provided, wherein each of the tabs 232*a* and 232*b* may by centered on the center axis BB of the body portion 220 to facilitate positioning of the gun slide grip 200 on the gun slide.

Additionally or alternatively, the body portion 220 may include at least one physical configuration feature defined by a second pair of recesses 240*b* that includes a recess disposed on each side of the second projecting tab 232*b* along the second edge 236*b*. Additionally or alternatively, the first edge 236*a* and second edge 236*b* may be disposed opposite each other on the body member 220 such that, for example, first projecting tab 232*a* and second projecting tab 232*b* are disposed on opposite edges of body member 220. Accordingly, the first edge 236*a* and second edge 236*b* may be disposed opposite each other on the body member 220 such that the first pair of recesses 240*a* and second pair of recesses 240*b* are disposed on opposite edges of body member 220. In this regard, as discussed in greater detail below, the disposition of the at least one physical configuration feature may facilitate the aligning of the center axis BB of the body portion 220 with the longitudinal axis of gun slide on the top side thereof.

The gun slide grip 200 may be in a substantially planar configuration prior to installation on a gun slide. As noted above, the gun slide grip 200 may include a first plurality of fingers 228*a*, corresponding to a first segmented portion 224*a*, for interposed positioning with a first plurality of separations of a gun slide. Similarly, the gun slide grip 200 may include a second plurality of fingers 228*b*, corresponding to a second segmented portion 224*b*, for interposed positioning with a second plurality of separations of the gun slide. According to the embodiment depicted in FIG. 11, each of the first plurality of fingers 228*a* and each of the second plurality of fingers 228*b* may extend at may extend at a common oblique angle along in entirety thereof relative to the center axis BB of the body portion 220. In this regard, each of the first plurality of fingers 228*a* and the second plurality of fingers 228*b* may be disposed relative to the body member 220 to facilitate conformal attachment to the gun slide for engagement of the gun slide by the user.

For example, with specific reference to FIG. 12, the gun slide grip 200 is depicted in a state where the gun slide grip 200 is installed on a gun slide 248. In this regard, the gun slide 248 may include a first plurality of serrations 252*a* (e.g., notches, grooves, or other indentations or voids) disposed on a first side 256*a* of gun slide 248 and a second plurality of serrations 252*b* (e.g., notches, grooves, or other indentations or voids) disposed on a second side 256*b* (not depicted in FIG. 12) of gun slide 248. In this regard, the first plurality of fingers 228*a* and the second plurality of fingers 282*b* may be disposed relative to the body member 220 to facilitate selective interposed adherence to the first plurality of serrations 252*a* and the second plurality of serrations 252*b*, respectively. As such, the gun slide grip 200 may facilitate conformal attachment to the gun slide 248 for engagement of the gun slide by a user.

Figure 13:
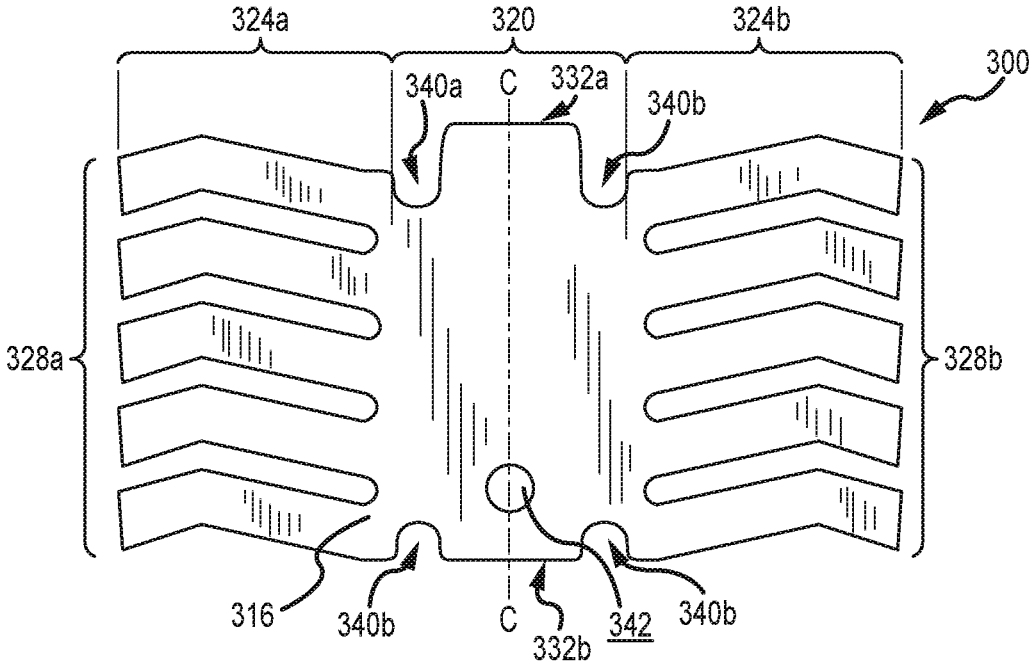
FIG. 13 is a top view of a gun slide grip, according to another embodiment.
Figure 14:
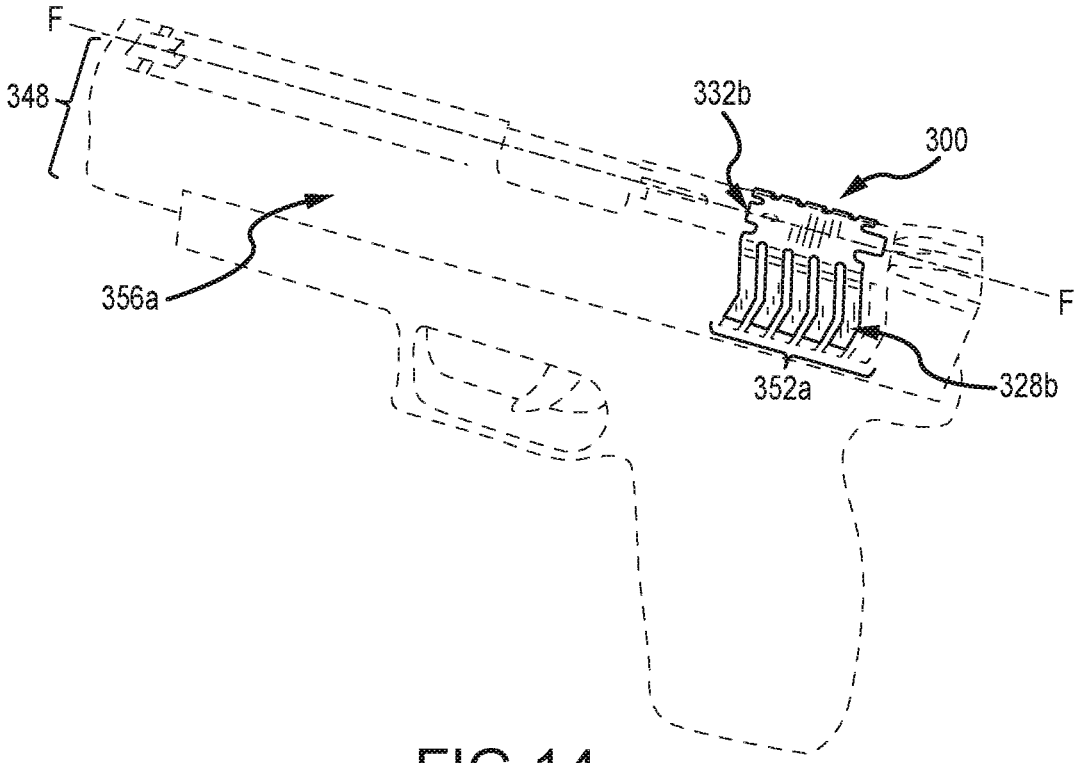
FIG. 14 depicts a side isometric view of the embodiment of the gun slide grip of FIG. 10 in a state in which the gun slide grip is installed on a gun slide.

Turning now to FIG. 13-14, a gun slide a grip 300 is depicted, according to another embodiment. Broadly, the gun slide grip 300 may include a flexible sheet member 304 having a bottom side 308 with an adhesive surface (not shown in FIG. 13) for attachment to a gun slide. The flexible sheet member 304 may also include a top side 312 with a grip surface 316 for engagement by a user. In this regard, the flexible sheet member 304 may further include a body portion 320 for positioning on a top side of a gun slide and at least a first segmented portion 324*a* integrally joined to the body portion 320. The adhesive surface may be overlaid by removable release liner 310 to substantially cover the adhesive surface of the gun slide grip 300 prior to installation on a gun slide. Notably, the first segmented portion 324*a* may include a first plurality of fingers 328*a* for interposed positioning with a first plurality of serrations of the gun slide. In some embodiments, the flexible sheet member 304 may also include a second segmented portion 324*b* integrally joined to the body portion 320. In this regard, the second segmented portion 324*b* may include a second plurality of fingers 328*b* for interposed positioning with a first plurality of serrations on the gun slide.

According to one embodiment, the first plurality of fingers 328*a* may extend away from the body portion 320 in a first direction on a first side of a center axis CC of the body portion 320 for interposed positioning with the first plurality of serrations on the first side of the gun slide, while the second plurality of fingers 328*b* may extend away from the body portion 320 in a second direction on a second side of the center axis CC of the body portion 320 for interposed positioning with the second plurality of serrations on a second side of the gun slide.

Furthermore, the body portion 320 may include at least one alignment feature for use in aligning a center axis CC of the body portion 320 with a longitudinal axis of the gun slide on the top side thereof. In this regard, the at least one alignment feature may include at least one of a physical configuration feature and a visual marking feature. According to one embodiment, the alignment feature of body portion 320 includes at least one physical configuration feature. According to this embodiment, the at least one physical configuration feature may include at least one of a projection portion located along an edge of the body portion 320, a recessed portion located along an edge of the body portion 320, and an opening extending through the body portion 320.

For example, the body portion 320 may include at least one physical configuration feature defined by a first projecting tab 332*a* located a long a first edge 336*a* of said body portion 320 such that the first projecting tab 332*a* is centered on a center axis CC of the body portion 320. Additionally or alternatively, the body portion 320 may include at least one physical configuration feature defined by a first pair of recesses 340*a* that includes a recess disposed on each side of the first projecting tab 332*a* along the first edge 336*a*. Each of the first pair of recesses 340*a* may be offset by an equal distance from the center axis CC of the body portion 320. In the same or other embodiments, the body portion 320 may include at least one physical configuration feature defined by a second projecting tab 332*b* located a long a second edge 336*b* of said body portion 320 such that the second projecting tab 332*b* is centered on the center axis CC of the body portion 320. In this regard, both a first projecting tab 332*a* and a second projecting tab 332*b* may be provided, wherein each of the tabs 332*a* and 332*b* may be centered on the center axis CC of the body portion 320 to facilitate positioning of the gun slide grip 300 on the gun slide.

Additionally or alternatively, the body portion 320 may include at least one physical configuration feature defined by a second pair of recesses 340*b* that includes a recess disposed on each side of the second projecting tab 332*b* along the second edge 336*b*. Additionally or alternatively, the first edge 336*a* and second edge 336*b* may be disposed opposite each other on the body member 320 such that, for example, first projecting tab 332*a* and second projecting tab 332*b* are disposed on opposite edges of body member 320. Accordingly, the first edge 336*a* and second edge 336*b* may be disposed opposite each other on the body member 320 such that the first pair of recesses 340*a* and second pair of recesses 340*b* are disposed on opposite edges of body member 320. In this regard, as discussed in greater detail below, the disposition of the at least one physical configuration feature may facilitate the aligning of the center axis CC of the body portion 320 with the longitudinal axis of gun slide on the top side thereof.

Additionally or alternatively, the body portion 320 may include an opening 342 extending therethrough as a physical configuration for use as an alignment feature. As illustrated, opening 342 may be centered on the center axis CC. While a circular configuration for opening 342 is illustrated, alternate configurations may be utilized (e.g. preferably configurations that provide coincidental, or mirror-like, opening portions on each side of a center axis of a body portion).

The gun slide grip 300 may be in a substantially planar configuration prior to installation on a gun slide. As noted above, the gun slide grip 300 may include a first plurality of fingers 328*a*, corresponding to a first segmented portion 324*a*, for interposed positioning with a first plurality of separations of a gun slide. Similarly, the gun slide grip 300 may include a second plurality of fingers 328*b*, corresponding to a second segmented portion 324*b*, for interposed positioning with a second plurality of serrations of the gun slide. According to the embodiment depicted in FIG. 13, a first portion of each of the first plurality of fingers 328*a* and each of the second plurality of fingers 328*b* may extend at a first angle relative to the center axis CC of the body portion 320 and a second portion joining the first portion of each of the first plurality of fingers 328*a* and each of the second plurality of fingers 328*b* extend at a second angle relative to the center axis CC of the body portion. In some instances, the first angle in the second angle may be of different angles. In this regard, each of the first plurality of fingers 328*a* and the second plurality of fingers 328*b* may be disposed relative to the body member 320 to facilitate conformal attachment to the gun slide for engagement of the gun slide by the user.

For example, with specific reference to FIG. 14, the gun slide grip 300 is depicted in a state where the gun slide grip 300 is installed on a gun slide 348. In this regard, the gun slide 348 may include a first plurality of serrations 352*a* (e.g., notches, grooves, or other indentations or voids) disposed on a first side 356*a* of gun slide 348 and a second plurality of serrations 352*b* (e.g., notches, grooves, or other indentations or voids) disposed on a second side 356*b* (not depicted in FIG. 14) of gun slide 348. In this regard, the first plurality of fingers 328*a* and the second plurality of fingers 328*b* may be disposed relative to the body member 320 to facilitate selective interposed adherence to the first plurality of serrations 352*a* and the second plurality of serrations 325*b*, respectively. As such, the gun slide grip 300 may facilitate conformal attachment to the gun slide 348 for engagement of the gun slide 348 by a user.

Figure 15:
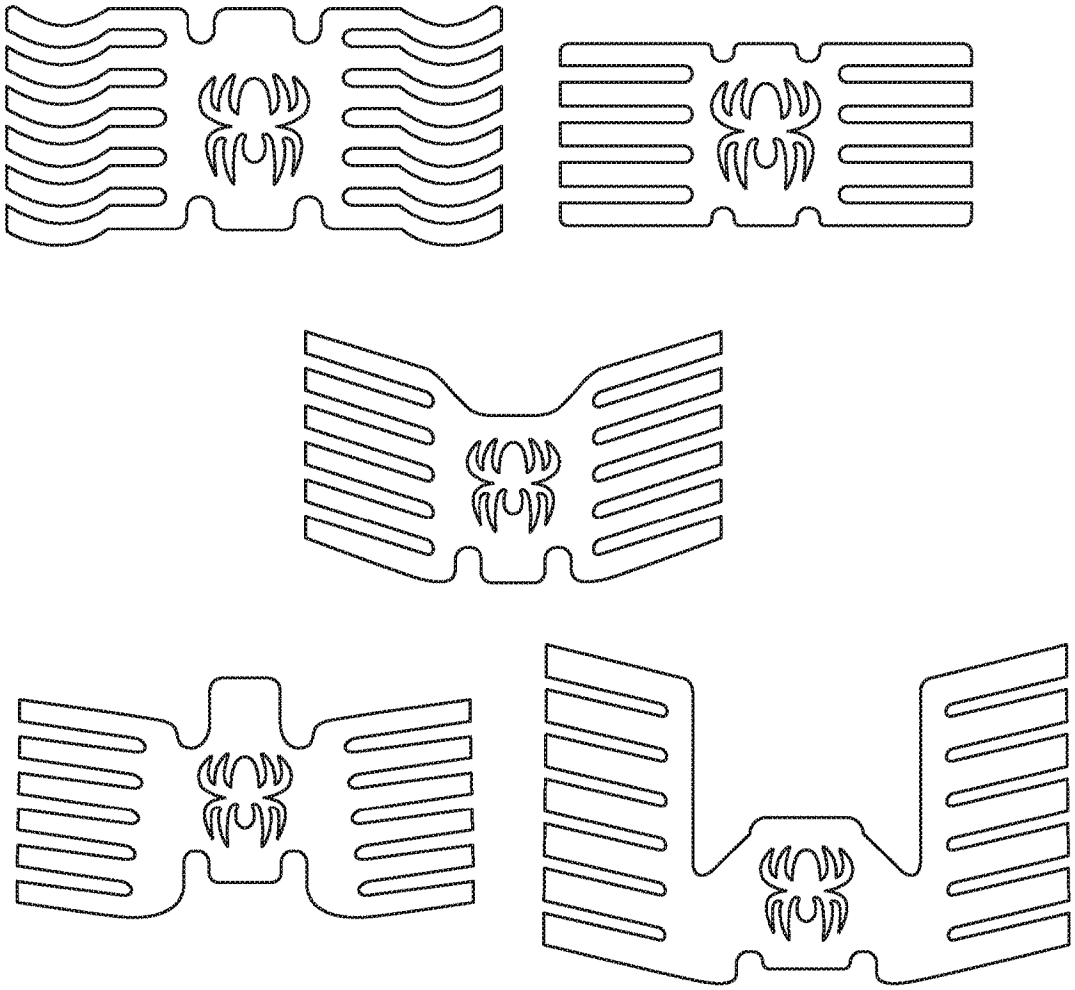
FIG. 15 is a top view of additional gun grips, according to further embodiments.

Numerous gun slide grip configurations may be provided. By way of example, FIG. 15 illustrates additional gun slide grip embodiments, which together with those described above, may all be of a laminar configuration and thickness as exemplified by FIG. 6. The embodiments shown in FIG. 15 each include an opening through the body portion that may be utilized for alignment purposes.

Figure 16:
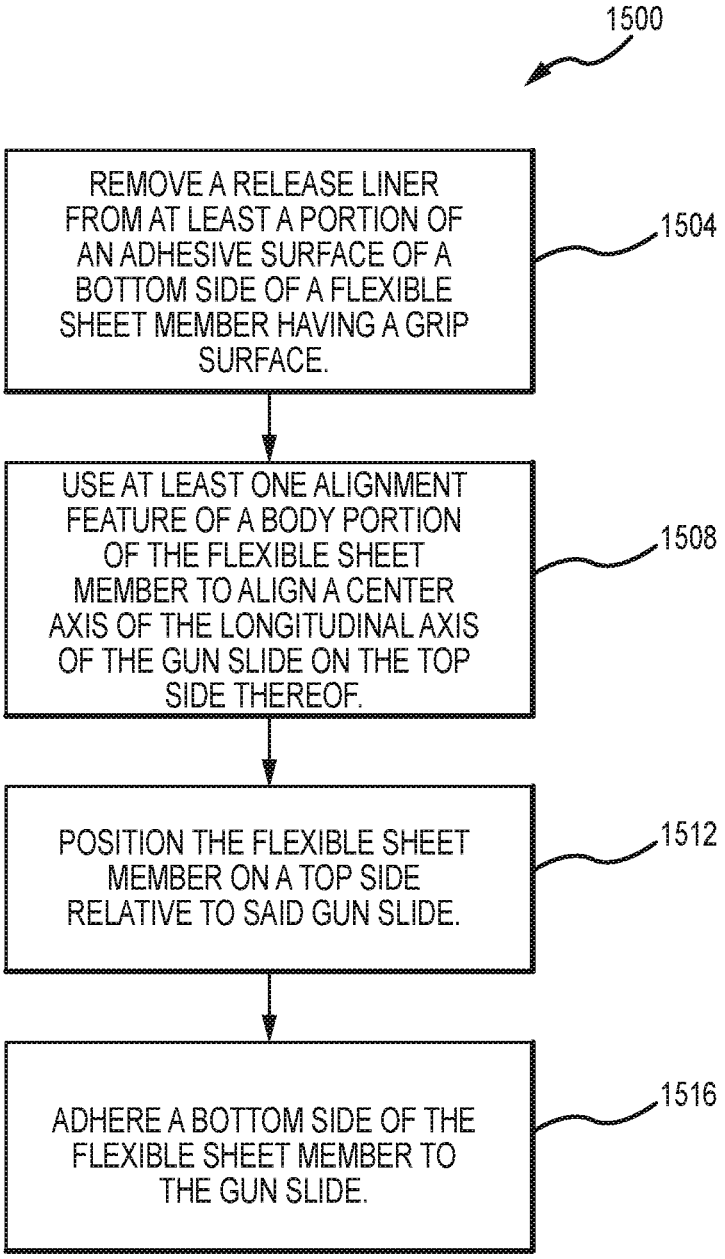
FIG. 16 illustrates with a flow diagram a method for installing a grip surface on a gun slide.

To further facilitate the reader's understanding of the various functionalities of the utilities discussed herein, reference is now made to flow diagram in FIG. 16, which illustrates method 1500 for use in installing a grip surface on a gun slide. While specific steps (and orders of steps) of method 1500 have been illustrated and will be discussed, other methods (including more, fewer or different steps than those illustrated) consistent with the teachings presented herein are also envisioned and encompassed with the present disclosure.

With reference to FIG. 16, method 1500 relates generally to a method for installing a grip surface (e.g., gun slide grip 100, etc.) on a surface of a gun slide (e.g., gun slide 148, etc.). Notably, the steps of method 1500 may be applicable to any embodiment of gun slide grip 100 for conformal attachment to a gun slide grip to facilitate engagement of a gun slide by a user. In this regard, the method 1500 may include removing 1504 a release liner (e.g., removable release liner 110) from at least a portion of an adhesive surface (e.g., adhesive surface 144) on a bottom side (e.g., bottom side 108) of the flexible sheet member. In this regard, the gun slide grip may be selectively attached to a gun slide by removing the release liner prior to installing the gun slide grip on to the gun slide. The method 1500 may further include using 1508 at least one alignment feature of the body portion (e.g., body portion 120) to align a center axis (e.g., center axis AA, etc.) of the body portion with a longitudinal axis of the gun slide on a top side thereof. In some instance, the alignment feature may be positioned proximal to the rear sight of the gun slide such that the gun slide grip is centered with the sides of the slide.

The method 1500 may further include positioning 1512 the flexible sheet member (e.g., gun slide grip 104) having a grip surface on a top side relative to a gun slide. In this regard, the gun slide grip may be gently tapped by a user for initial positing onto the flexible sheet member to facilitate removal of the gun slide grip for any needed subsequent realignment. Each individual finger of the gun slide grip may be rolled into the serrations of the gun slide for proper positioning therein. The method 1500 may further include adhering 1516 a bottom side of the flexible sheet member to the gun slide. In this regard, a user may press down firmly on all areas of the gun slide grip to facilitate adhering the gun slide grip to the gun slide. In some instances, the gun slide grip may be adhered to a gun slide via heat provided by a hair dryer. In some instances, gun slide should be cleaned using alcohol wipes (e.g., cleaning between serrations of the gun slide) before adhering the gun slide grip to a gun slide. Notably, the flexible sheet member may substantially conform to the exterior contour of a gun slide to facilitate the conformal attachment of the gun slide grip to the gun slide for engagement of the gun slide by a user.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, or within the scope of the present invention. The embodiments described herein above are further intended to explain best modes known of practicing the invention and to enable others skilled in the art to utilize the invention in such, or other embodiments, and with various modifications required by the particular application(s) or use(s) of the present invention it is intended that the appended claims be construed to include alternative embodiments to the extent permitted by the prior art.

What is claimed is:

1. A gun slide grip for installed use on a gun slide, comprising:

a flexible sheet member having a bottom side with an adhesive surface for attachment to a gun slide and a top side with a grip surface for engagement by a user, and further comprising:

a body portion for positioning on a top side of said gun slide; and a first segmented portion integrally adjoined to said body portion and including a first plurality of fingers for interposed positioning with a first plurality of serrations on said gun slide.

2. The gun slide grip as recited in claim 1, wherein said grip surface comprises:

abrasive particles in a matrix; or an elastomer material.

3. The gun slide grip as recited in claim 1, wherein said grip surface comprises:

silicon carbide or aluminum oxide particles in a polymer matrix.

4. The gun slide grip as recited in claim 1, further comprising:

a removable release liner overlaying said adhesive surface.

5. The gun slide grip as recited in claim 4, wherein said removable release liner comprises a first and second portion that are separated for selective, separate removal from said adhesive surface.

6. The gun slide grip as recited in claim 1, wherein said sheet member further comprises:

a second segmented portion integrally adjoined to said body portion and including a second plurality of fingers for interposed positioning with a second plurality of serrations on said gun slide.

7. The gun slide grip as recited in claim 6, wherein said first plurality of fingers extend away from said body portion in a first direction on a first side of a center axis of the body portion for interposed positioning in said first plurality of serrations on a first side of said gun slide, and wherein said second plurality of fingers extend away from said body portion in a second direction on a second side of the center axis of the body portion for interposed positioning with said second plurality of serrations on a second side of said gun slide opposite said first side.

8. The gun slide grip as recited in claim 7, wherein said body portion comprises:

at least one alignment feature for use in aligning the center axis of said body portion with a longitudinal axis of said gun slide on said top side thereof.

9. The gun slide grip as recited in claim 8, wherein said at least one alignment feature comprises at least one of:

a physical configuration feature; and a visual marking feature.

10. The gun slide grip as recited in claim 9, wherein said at least one alignment feature comprises a at least one physical configuration feature, and said at least one physical configuration feature comprises at least one of:

a projection portion located along an edge of said body portion;

a recessed portion located along an edge of said body portion; and, an opening extending through said one body portion.

11. The gun slide grip as recited in claim 10, wherein said at least one physical configuration feature comprises:

a first projecting tab located along a first edge of said body portion.

12. The gun slide grip as recited in claim 11, wherein said first projecting tab is centered on said center axis of the body portion.

13. The gun slide grip as recited in claim 11, wherein said at least one physical configuration feature further comprises:

a first pair of recesses comprising a recess on each side of said first projecting tab along said first edge.

14. The gun slide grip as recited in claim 13, wherein each of said first pair of recesses are offset by an equal distance from the center axis of the body portion.

15. The gun slide grip as recited in claim 11, wherein said at least one physical configuration feature further comprises:

a second projecting tab located along a second edge of said body portion, wherein said first and second projecting tabs are each centered on the center axis of the body portion.

16. The gun slide grip as recited in claim 15, wherein said at least one physical configuration feature further comprises:

a first pair of recesses comprising a recess on each side of the first projecting tab along said first edge of the body portion; and a second pair of recesses comprising a recess on each side of the second projecting tab along the second edge of the body portion.

17. A gun slide grip as recited in claim 8, wherein said at least one alignment feature is located for positioning on said top side of said gun slide.

18. The gun slide grip as recited in claim 7, wherein when said sheet member is in a planar configuration prior to installation, each of said first plurality of fingers and each of said second plurality of fingers extend at a 90° angle along an entirety thereof relative to the center axis of the body portion.

19. The gun slide grip as recited in claim 7, wherein when said sheet member is in a planar configuration prior to installation, each of first plurality of fingers and each of said second plurality of fingers extend at a common oblique angle along an entirety thereof relative to the center axis of the body portion.

20. A gun slide grip as recited in claim 7, wherein when said sheet member is in a planar configuration prior to installation, a first portion of each of said first plurality of fingers and each of said second plurality of fingers extends at a first angle relative to the center axis of said body portion, and wherein a second portion adjoining said first portion of each of said first plurality of fingers and each of said second plurality of fingers extends at a second angle relative to said center axis of said body portion, wherein said first angle and said second angle are different.

* * * * *